US009963967B2

(12) United States Patent
Bergmann et al.

(10) Patent No.: US 9,963,967 B2
(45) Date of Patent: May 8, 2018

(54) AXIAL PISTON MACHINE UTILIZING A BENT-AXIS CONSTRUCTION WITH A DRIVE JOINT FOR DRIVING THE CYLINDER BARREL

(71) Applicant: Linde Hydraulics GmbH & Co. KG, Aschaffenburg (DE)

(72) Inventors: Martin Bergmann, Schaafheim (DE); Sabine Kausch, Weilbach (DE)

(73) Assignee: Linde Hydraulics GmbH & Co. KG, Aschaffenburg (DE)

( * ) Notice: Subject to any disclaimer, the term of this patent is extended or adjusted under 35 U.S.C. 154(b) by 473 days.

(21) Appl. No.: 14/674,164

(22) Filed: Mar. 31, 2015

(65) Prior Publication Data

US 2015/0285077 A1 Oct. 8, 2015

(30) Foreign Application Priority Data

Apr. 8, 2014 (DE) ..... 10 2014 104 953

(51) Int. Cl.
*F01B 3/00* (2006.01)
*F04B 1/20* (2006.01)
(Continued)

(52) U.S. Cl.
CPC ..... *F01B 3/0032* (2013.01); *F01B 3/0082* (2013.01); *F03C 1/0636* (2013.01);
(Continued)

(58) Field of Classification Search
CPC ..... F04B 1/122; F04B 1/20; F04B 1/2085; F04B 1/328; F04B 1/30; F04B 53/18; F04B 27/109
(Continued)

(56) References Cited

U.S. PATENT DOCUMENTS 2,146,133 A 2/1939 Tweedale
2,633,104 A * 3/1953 Lauck ..... F01B 3/0047 91/505
(Continued)

FOREIGN PATENT DOCUMENTS

DE 4481042 T1 8/1996
DE 10154921 A1 * 5/2003 ..... F04B 1/124
(Continued)

*Primary Examiner* — Thomas E Lazo
(74) *Attorney, Agent, or Firm* — The Webb Law Firm

(57) ABSTRACT

A hydrostatic axial piston machine (1) utilizing a bent-axis construction has a drive shaft (4) with a drive flange (3) rotatable around an axis of rotation ($R_t$) inside a housing (2). A cylinder barrel (7) is located inside the housing (2) and is rotatable around an axis of rotation ($R_Z$). A drive joint (30) is located between the drive shaft (4) and the cylinder barrel (7). The drive joint (30) has at least one drive body (M1; M2; M3; M4) in the form of a slider or a roller body which is supported in the drive shaft (4) and the cylinder barrel (7). A lubrication device (80) is provided for the drive joint (30) and supplies lubricant from a lubricant port (81) located on the housing (2) of the axial piston machine (1) to the drive bodies (M1; M2; M3; M4) for cooling and lubrication of the drive bodies (M1; M2; M3; M4).

18 Claims, 3 Drawing Sheets

(51) Int. Cl.
*F04B 53/18* (2006.01)
*F03C 1/06* (2006.01)
*F04B 27/10* (2006.01)

(52) U.S. Cl.
CPC ..... *F04B 1/20* (2013.01); *F04B 53/18* (2013.01); *F04B 27/109* (2013.01)

(58) Field of Classification Search
USPC ..... 92/12.2, 71, 153
See application file for complete search history.

(56) References Cited

U.S. PATENT DOCUMENTS 3,162,142 A * 12/1964 Wiggermann ..... F01B 3/0038 91/500
3,357,209 A * 12/1967 Mooney, Jr. ..... F16D 3/22 464/141
3,943,828 A * 3/1976 Wagenseil ..... F04B 1/124 91/499
4,361,077 A * 11/1982 Mills ..... F01B 3/0038 91/500
4,872,394 A * 10/1989 Nakagawa ..... F04B 1/2035 91/506
5,033,358 A 7/1991 Molly
5,636,561 A * 6/1997 Pecorari ..... F04B 1/2035 123/43 A
5,836,748 A 11/1998 Kawaguchi et al.
6,406,271 B1 * 6/2002 Valentin ..... F04B 1/126 417/269
7,357,067 B2 * 4/2008 Galba ..... F04B 1/124 92/12.2
7,731,485 B2 * 6/2010 Achten ..... F01B 3/0038 417/269
7,966,924 B1 * 6/2011 Peters ..... F04B 9/042 91/506

FOREIGN PATENT DOCUMENTS

EP 0205982 A2 12/1986
EP 1508695 A1 2/2005

* cited by examiner

AXIAL PISTON MACHINE UTILIZING A BENT-AXIS CONSTRUCTION WITH A DRIVE JOINT FOR DRIVING THE CYLINDER BARREL

CROSS REFERENCE TO RELATED APPLICATIONS

This application claims priority to German Application No. DE102014104953.5 filed Apr. 8, 2014, which is herein incorporated by reference in its entirety.

BACKGROUND OF THE INVENTION

Field of the Invention

This invention relates to a hydrostatic axial piston machine utilizing a bent-axis construction having a drive shaft located inside a housing and rotatable around an axis of rotation. The drive shaft has a drive flange. A cylinder barrel is located inside the housing of the axial piston machine and rotates around an axis of rotation. The cylinder barrel has a plurality of piston bores. A longitudinally displaceable piston is located in each piston bore. The pistons are fastened to the drive flange in an articulated manner. A drive joint for driving the cylinder barrel is located between the drive shaft and the cylinder barrel. The drive joint has at least one drive body in the form of a slider or roll body which is supported on the drive shaft and the cylinder barrel.

Description of Related Art

In hydrostatic axial piston machines utilizing a bent-axis construction, the longitudinally displaceable pistons located in the cylinder barrel are generally fastened to the drive flange of the drive shaft by a ball joint. The piston forces are transmitted by the piston to the drive flange located on the drive shaft and generate a torque. In axial piston machines utilizing a bent-axis construction, during rotation there is theoretically no drive of the cylinder barrel with the pistons located in it. For driving of the cylinder barrel, a drive joint is necessary and is located between the drive shaft and the cylinder barrel. A drive joint that employs the Rzeppa principle or the tripod principle can be used, in which the cylinder barrel is driven by at least one drive body in the form of a roll body or a slider that transmits a torque between the drive shaft and the cylinder barrel for driving the cylinder barrel.

Generic axial piston machines employing a bent-axis construction have significantly higher maximum allowable speeds of rotation than axial piston machines utilizing a swashplate construction. Thus, axial piston machines utilizing a bent axis construction have advantages for use as a hydraulic motor.

In hydrostatic axial piston machines, the housing inside which the rotating drive shaft and the rotating cylinder barrel are located is filled with a pressure medium, such as hydraulic oil, to provide cooling and lubrication of the components. During operation of the axial piston machine with a rotating drive shaft and rotating cylinder barrel, this arrangement results in churning losses that increase extra-proportionally as the speed of rotation increases. These churning losses represent an additional consumption of energy, which in an axial piston machine in the form of a pump must be compensated for by the drive system and result in an undesirable power loss, or in an axial piston machine in the form of a motor resulting in a lower output power. In particular, at high speeds of rotation of the rotating components, this power loss can be of a significant magnitude, as a result of which the efficiency and potential applications of axial piston machines at high speeds of rotation are limited and restricted.

To eliminate these disadvantages, the housing of the hydrostatic axial piston machine can be emptied of hydraulic fluid to reduce the losses caused by the churning of the rotating components and to increase the efficiency of the axial piston machine at higher speeds of rotation.

In a hydrostatic axial piston machine and with a housing emptied of hydraulic fluid, however, sufficient cooling and lubrication of the drive bodies of the drive joint are no longer guaranteed.

An object of this invention is to provide an axial piston machine that can be operated with a housing that has been emptied of hydraulic fluid and simultaneously guarantees sufficient lubrication and cooling of the drive bodies of the drive joint.

SUMMARY OF THE INVENTION

This object is accomplished by the invention in that there is a lubrication device for the drive joint, by means of which lubricant is delivered to the drive body by a lubricant port located on the housing of the axial piston machine for the cooling and lubrication of the drive body. With a lubrication device of this type for the drive joint, it is possible in a simple manner and with little extra construction effort or expense to supply the drive bodies of the drive joint with lubricant, such as hydraulic fluid, which is delivered via a lubricant port on the housing of the axial piston machine. During operation of the axial piston machine with a housing that has been emptied of hydraulic fluid, sufficient cooling and lubrication of the drive bodies of the drive joint for the operation of the machine, in particular at high speeds of rotation, is provided by the lubricant delivered via the lubrication device.

Supply of the drive bodies of the drive joint with lubricant that is delivered via the lubricant port on the housing can be ensured with little extra construction effort or expense if the lubrication device is located in the drive shaft and has a lubricant channel located in the drive shaft. When the axial piston machine is operated with a housing that has been emptied of hydraulic fluid, lubricant is transported from the lubricant port on the housing to the drive bodies of the drive joint in a simple manner via the lubricant channel located in the drive shaft.

In one advantageous embodiment of the invention, the lubricant channel has a lubricant supply boring located in the drive shaft and which is in connection with the lubricant port. At least one lubrication boring is located in the drive shaft and is connected to the lubricant supply boring and extends to the peripheral surface of the drive shaft and is provided in the peripheral surface with an opening. The opening of the lubrication boring in the peripheral surface is located and oriented such that when the drive shaft is in rotation, the lubricant delivered via the lubricant supply boring and the lubrication boring flows to the drive bodies by the action of centrifugal force. To supply the drive bodies of the drive joint with lubricant, a lubricant supply boring is introduced into the drive shaft of the axial piston machine. For each drive body, a transverse boring in the form of a lubricant boring is connected to this lubricant supply boring, which lubrication boring is located in the drive shaft and is provided on the external periphery of the drive shaft with an opening, through which the lubricant delivered by the lubricant supply boring can be discharged and can flow directly onto the corresponding drive bodies of the drive joint. A lubricant supply boring and corresponding lubrication borings in the form of transverse borings can be made in the drive shaft of the axial piston machine with little extra construction effort or expense. When the drive shaft is in rotation, lubricant can therefore flow by centrifugal force to the drive bodies so that when the drive shaft is in rotation, the drive bodies are lubricated and cooled by the lubricant that is supplied via the lubricant supply boring and the lubrication boring.

In one embodiment of the invention, the drive body is located in a bed in the drive shaft and in a bed in the cylinder barrel. The lubrication device makes possible a controlled delivery of lubricant to the drive bodies in the vicinity of the two beds.

It is particularly advantageous if the lubrication boring opens toward the drive body. This measure makes it possible in a simple manner for the lubricant delivered via the lubricant supply boring and the lubrication boring to flow directly to the drive bodies under the effect of centrifugal force, so that the drive bodies are wetted with lubricant in a targeted manner and are cooled and lubricated with a small quantity of lubricant.

Depending on the drive torque to be transmitted between the drive shaft and the cylinder barrel, it may be sufficient, if the drive torques to be transmitted is low, to provide a single drive body. For higher drive torques to be transmitted between the drive shaft and the cylinder barrel, the number of drive bodies can be increased. If a plurality of drive bodies are provided, a lubrication boring is advantageously provided for each drive body distributed over the periphery. This measure makes it possible to supply each drive body with lubricant for cooling and lubrication in a simple manner via the associated lubrication boring, so that the plurality of drive bodies of the drive joint can be reliably cooled and lubricated with a small quantity of lubricant.

In one advantageous embodiment of the invention, the lubricant supply boring is a longitudinal boring in the drive shaft coaxial to the axis of rotation of the drive shaft. A longitudinal boring oriented coaxially (and thus a center boring in the drive shaft) can be created with little additional construction effort or expense.

In one advantageous development of the invention, the lubricant supply boring extends to a bearing device, by means of which the drive shaft is rotationally mounted in the housing. This makes it possible in a simple manner to create a connection of the lubricant supply boring with the lubricant port located on the housing.

In one particularly advantageous embodiment of the invention, the drive shaft is mounted on bearings in the housing on both sides of the cylinder barrel. The bearing system of the drive shaft in the housing comprises a drive-flange-side bearing device and a cylinder-barrel-side bearing device. The lubricant supply boring extends to the cylinder-barrel-side bearing device. In an axial piston machine that utilizes a bent-axis construction, as a rule the drive or output torque of the axial piston machine is introduced or discharged via the drive-flange-side area of the drive shaft that is supported in the housing by means of the drive-flange-side bearing device, so that the cylinder-barrel-side area of the drive shaft, which is mounted in the housing by means of the cylinder-barrel-side bearing device, is exposed to a lower load. Advantages therefore result from the location of the lubricant channel in the cylinder-barrel-side area of the drive shaft, because the drive shaft is not weakened by the lubricant supply boring and the lubrication borings in terms of the transmission of the drive or output torque, which would otherwise require the drive shaft to have a larger diameter.

In one advantageous embodiment of the invention, the lubricant supply boring is provided in the vicinity of the bearing device with a feed opening which is in communication with the lubricant port located on the housing of the axial piston machine. With a feed opening of this type, the lubricant supply boring can be connected in a simple manner with the lubricant port located on the housing of the axial piston machine, to supply the lubrication device with lubricant.

It is advantageous with regard to minimizing the amount of extra construction effort and expense involved, if the feed opening is located on an axial end surface of the drive shaft.

In one advantageous development of the invention, a lubricant chamber is formed between the bearing device, the end surface of the drive shaft and the housing, and is in communication with the lubricant port. This makes it possible in a simple manner to use the lubricant fed in via the lubricant port on the housing for both the lubrication and cooling of the drive bodies of the drive joint as well as for the lubrication and cooling of the bearing device of the drive shaft. During operation of the axial piston machine with the housing emptied of hydraulic fluid, a cooling and lubrication of the cylinder-barrel-side bearing device of the drive shaft and of the drive bodies of the drive joint can be achieved with little extra construction effort or expense.

In one preferred embodiment of the invention, each drive body is in the form of a pair of drive bodies with two half-bodies, which are located alternately in the drive shaft and the cylinder barrel, and are in contact with each other by means of contact surfaces. The drive body pair has a cylinder-barrel-side half-body that corresponds to the cylinder barrel and a drive-shaft-side half-body that corresponds to the drive shaft. The cylinder-barrel-side half-body of the drive body pair is held in a groove-like bed in the cylinder barrel and the drive-shaft-side half-body of the drive body pair is held in a groove-like-bed in the drive shaft.

In one advantageous embodiment of the invention, the lubrication device can be used to supply lubricant to the half-bodies in the vicinity of the contact surfaces and/or in the vicinity of the groove-like beds. The half-bodies of the drive body pair can thus be cooled and lubricated with the lubrication device of the invention in a simple manner at the contact surfaces or on the surfaces with which the half-bodies are located in the groove-like beds.

In one preferred embodiment of the invention, the drive joint is a synchronous drive joint for the rotationally synchronous rotation of the cylinder barrel and the drive shaft. With a rotationally synchronous drive of the cylinder barrel, a uniform drive or output torque on the drive shaft is achieved and the loads on the components of the axial piston machine can be reduced. In addition, with a rotationally synchronous drive joint, the noise generated by the axial piston machine and by a drivetrain coupled with the axial piston machine can be reduced.

In one advantageous development of the invention, the drive joint is a cone-beam half-roller joint that has at least one roller pair as a drive body pair with two semi-cylindrical half-rollers as the half-bodies. The semi-cylindrical half-rollers are flattened to an axis of rotation, and the half-rollers, on the flattened sides, form flat slide faces as contact surfaces with which the half-rollers of the roller pair are in planar contact. With a drive joint in the form of a cone-beam half-roller joint, with little extra construction effort or expense for the drive joint, a drive of the cylinder barrel can be achieved in an axial piston machine utilizing a bent-axis construction. A cone-beam half-roller joint between the drive shaft and the cylinder barrel can be realized in a simple manner by a corresponding geometric design in the form of a homokinetic or constant velocity joint, in which an exact and uniform and therefore rotationally synchronous drive of the cylinder barrel is achieved. In addition, with a cone-beam half-roller joint as a drive joint located between the drive shaft and the cylinder barrel for driving the cylinder barrel, the drive shaft can be extended in a simple manner all the way through the cylinder barrel or the axial piston machine in the axial direction, so that it becomes possible to have bearings for the drive shaft on both sides of the cylinder barrel. In a cone-beam half-roller joint, the half-rollers of each roller pair are each located in pairs. The half-rollers of a roller pair of the cone-beam half-roller joint are formed by cylindrical bodies flattened to the axis of rotation and, thus, to the longitudinal axis. As a result of the flattening, on the flattened sides of the half-rollers, flat slide faces are formed as contact surfaces at which the two half-rollers of a roller pair are in contact with each other and at which the transmission of force occurs by means of planar contact between the two flat surfaces. With roller pairs of this type, each of which includes two semi-cylindrical half-rollers whose half-rollers are flattened to an axis of rotation and thus along the longitudinal axis of the half-rollers, and which are in contact with each other on the flattened sides to achieve planar contact and form flat slide faces, the forces (and thus the torque) for driving the cylinder barrel can be transmitted with little extra construction effort or expense because the half-rollers are easy and economical to manufacture. Because the contact surfaces between the two half-rollers of a roller pair are flat slide faces and planar contact between the two half-rollers of a roller pair occurs for the transmission of force, when high forces are to be transmitted for the drive of the cylinder barrel, the Hertzian stresses that occur are low. The cone-beam half-roller joint formed by the corresponding roller pairs is therefore robust enough to withstand the overloads that can occur during a high rotational acceleration, for example. When the axial piston machine is a hydraulic motor, the axial piston machine can also be used in applications with high rotational accelerations. With the lubrication device of the invention, during operation of the axial piston machine with a housing that has been emptied of hydraulic fluid, lubricant can be supplied for cooling and lubricating of the two half-rollers in the vicinity of the contact surfaces, which are in the form of slide faces.

It is particularly advantageous if, the drive body, in particular the half-rollers, is located in the radial direction inside the piston and at a distance from the axis of rotation of the drive shaft and of the cylinder barrel. The drive joint, which is preferably a cone-beam half-roller joint, is therefore located inside the ring and the reference circle of the pistons, as a result of which a space-saving design of the axial piston machine can be achieved, and by means of the lubricant channel in the drive shaft, lubricant for cooling and lubrication can be delivered in a targeted manner by centrifugal force to the drive bodies. In addition, the drive bodies, such as the half-rollers of the roller pairs, are at a vertical distance from the axis of rotation of the drive shaft and from the axis of rotation of the cylinder barrel, so that the torque to drive the cylinder barrel can be transmitted at the contact surfaces formed by the flat slide faces and, thus, the contact surfaces. This arrangement of the drive bodies of the drive joint, in particular of the half-rollers of the cone-beam half-roller joint, also makes it possible in a simple manner to provide the drive joint with a longitudinal recess that is oriented concentric to the axis of rotation of the cylinder barrel, so that it becomes possible to extend the drive shaft through the cylinder barrel to provide a bearing on both sides and to supply the drive body with lubricant for cooling and lubrication by means of a lubricant channel located in the drive shaft.

In one advantageous embodiment of the invention, each roller pair has a cylinder-barrel-side half-roller that corresponds to the cylinder barrel and a drive-shaft-side half-roller that corresponds to the drive shaft. The cylinder-barrel-side half-roller of a roller pair is housed in a cylindrical, or at least partly cylindrical, cylinder-barrel-side receptacle in the form of a groove-like bed and the drive-shaft-side half-roller of a roller pair is housed in a cylindrical, or at least partly cylindrical, drive-shaft-side receptacle in the form of a groove-like bed. With roller pairs of this type, the forces and a torque to drive the cylinder barrel can be transmitted in a simple manner. The cylindrical receptacles in which the corresponding half-rollers are housed and bedded can be manufactured in a simple manner and with little extra manufacturing effort or expense, as a result of which, in connection with the half-rollers, which are simple and easy to manufacture, the drive joint for the drive of the cylinder barrel requires little extra manufacturing effort or expense. With the lubrication device of the invention, the two half-rollers can also be supplied with lubricant for cooling and lubrication in the vicinity of the groove-like beds in the drive shaft and the cylinder barrel during operation of the axial piston machine with a housing emptied of hydraulic fluid.

The axial piston machine of the invention can be operated only in one direction of rotation, whereby it is sufficient for this direction of rotation to provide one or a plurality of drive bodies that make possible a transmission of the drive torque in the desired direction of rotation between the drive shaft and the cylinder barrel.

Alternatively, in one advantageous embodiment of the invention, the axial piston machine can be operated in both directions of rotation, whereby for each direction of rotation, at least one drive body is provided for the rotationally synchronous drive of the cylinder barrel. This makes possible in a simple manner a transmission of a drive torque in both directions of rotation between the drive shaft and the cylinder barrel.

The axial piston machine of the invention can be a constant displacement machine with a fixed displacement volume.

When the drive joint is in the form of a cone-beam half-roller joint, which can be manufactured in a simple manner in the form a constant velocity joint, for driving the cylinder barrel, a variation of the pivoting angle, i.e., of the axes of rotation of the drive shaft and of the cylinder barrel with respect to one another, is possible, so that with little added construction effort or expense, the axial piston machine can be constructed in the form of a variable displacement machine with a variable displacement volume.

BRIEF DESCRIPTION OF THE DRAWING(S)

Additional advantages and details of the invention are explained in greater detail below with reference to the exemplary embodiment illustrated in the accompanying schematic figures, in which like reference numbers identify like parts throughout.

DESCRIPTION OF THE PREFERRED EMBODIMENTS

Figure 1:
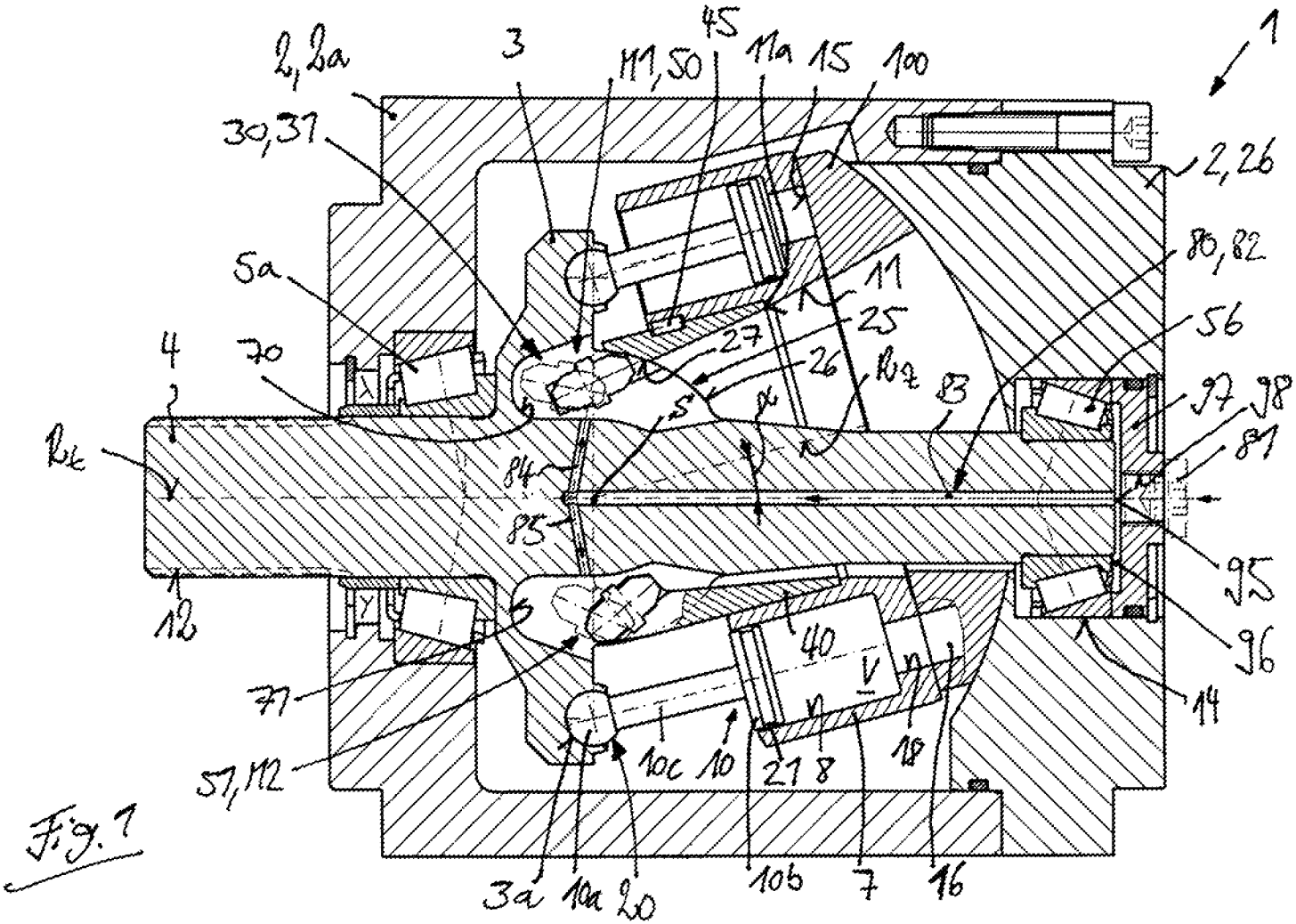
FIG. 1 shows an axial piston machine utilizing a bent-axis construction of the invention in a longitudinal section.
Figure 2:
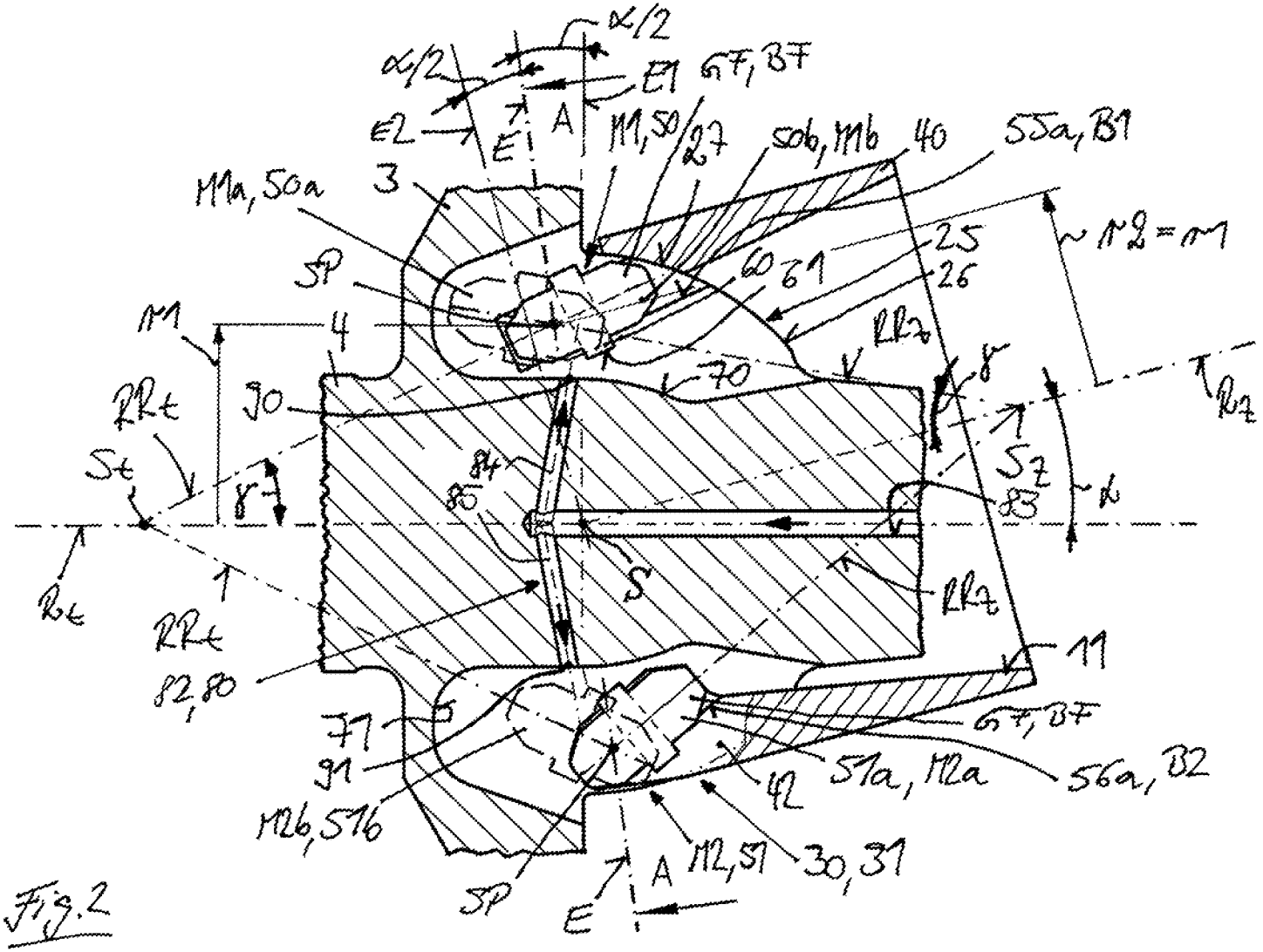
FIG. 2 is a detail on an enlarged scale from FIG. 1 in the vicinity of the drive joint.
Figure 3:
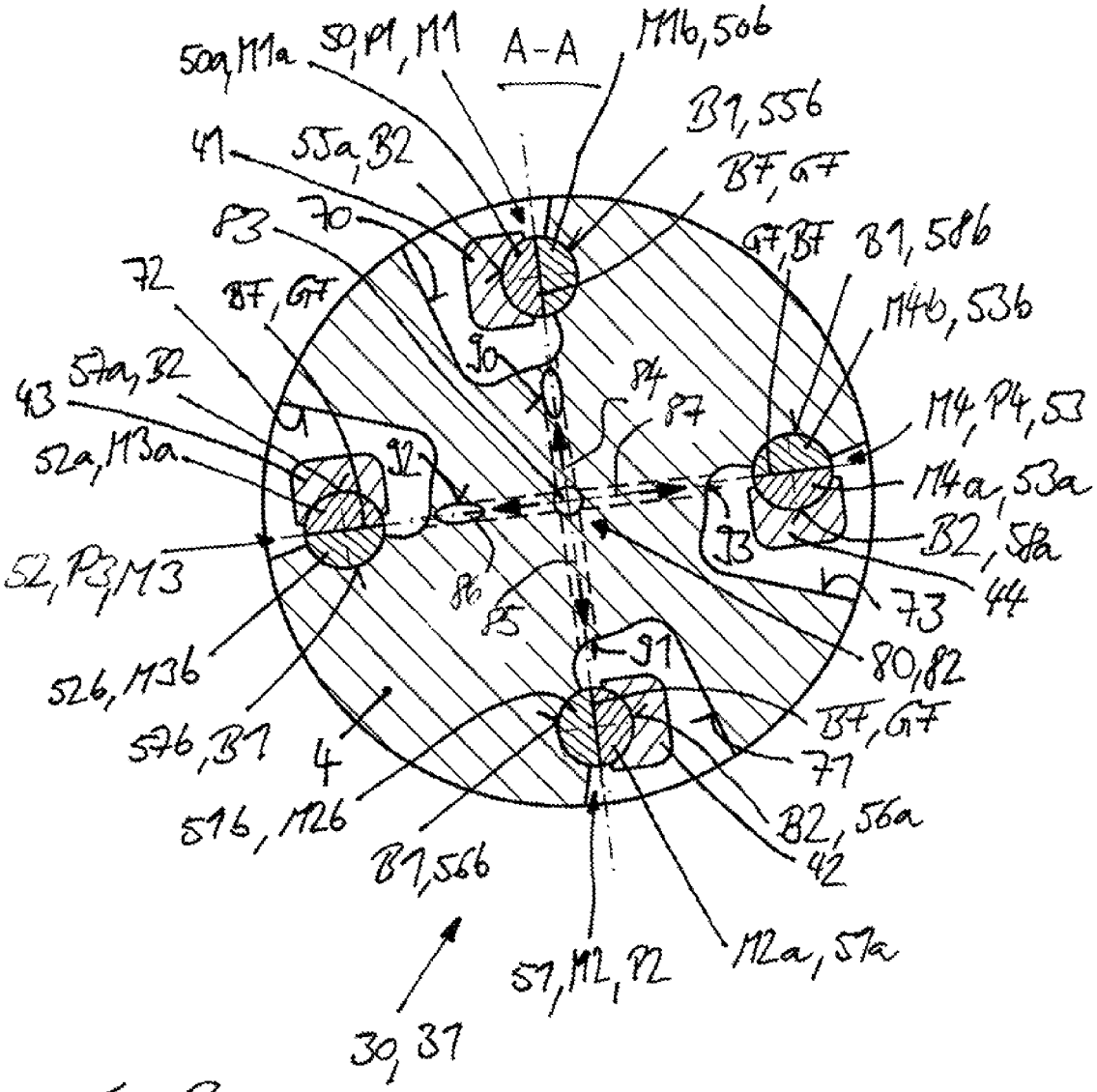
FIG. 3 is a section along line A-A in FIG. 2.

A hydrostatic axial piston machine 1 of the invention utilizing a bent-axis construction is illustrated in FIGS. 1 to 3. The machine 1 has a housing 2 that includes a housing barrel 2*a* and a housing cover 2*b*. A drive shaft 4 having a drive flange 3 is mounted in the housing 2 by means of bearing devices 5*a*, 5*b* so that it can rotate around an axis of rotation $R_t$. In the illustrated exemplary embodiment, the drive flange 3 is formed in one piece on the drive shaft 4.

Located in the housing 2 axially next to the drive flange 3 is a cylinder barrel 7 which rotates around an axis of rotation $R_Z$ and has a plurality of piston bores 8, which in the illustrated exemplary embodiment are arranged concentrically around the axis of rotation $R_Z$ of the cylinder barrel 7. A longitudinally displaceable piston 10 is located in each piston bore 8.

The axis of rotation $R_t$ of the drive shaft 4 intersects the axis of rotation $R_Z$ of the cylinder barrel 7 at the intersection point S.

The cylinder barrel 7 is provided with a central longitudinal recess 11 oriented concentric to the axis of rotation $R_Z$ of the cylinder barrel 7, and through which the drive shaft 4 extends. The drive shaft 4 is mounted on both sides of the cylinder barrel 7 by means of the bearing devices 5*a*, 5*b*. The drive shaft 4 is mounted with the drive-flange-side bearing device 5*a* in the housing barrel 2*a* and with the cylinder-barrel-side bearing device 5*b* in the housing cover 2*b*.

The drive shaft 4 is equipped on the drive-flange-side end with torque transmission means 12, such as splines, for the introduction of a drive torque or for the tapping of an output torque. The opposite, cylinder-barrel-side end of the drive shaft 4 ends in the vicinity of the housing cover 2*b*. In the housing cover 2*b*, to hold the drive shaft 4 and the bearing device 5*b*, there is a boring 14 that is concentric to the axis of rotation $R_t$ of the drive shaft 4 and, in the illustrated exemplary embodiment, is a through hole.

For control of the feed and discharge of hydraulic fluid in the displacement chambers V formed by the piston bores 8 and the pistons 10, the cylinder barrel 7 is in contact with a control surface 15, which is provided with kidney-shaped control bores that form an inlet port 16 and an outlet port of the axial piston machine 1. For connection of the displacement chambers V with the control bores, the cylinder barrel 7 is provided with a control opening 18 at each piston bore 8. The axial piston machine 1 illustrated in FIG. 1 is in the form of a variable displacement machine with a variable displacement volume. On a variable displacement machine, the angle of inclination $\alpha$, and thus the pivoting angle of the axis of rotation $R_Z$ of the cylinder barrel 7, is variable with respect to the axis of rotation $R_t$ of the drive shaft 4 for varying the displacement volume. The control surface 15 with which the cylinder barrel 7 is in contact is for this purpose formed on a cradle body 100 located in the housing 2 so that it can pivot around a pivoting axis that lies at the point of intersection S of the axis of rotation $R_t$ of the drive shaft 4 and of the axis of rotation $R_Z$ of the cylinder barrel 7 and is oriented perpendicularly to the axes of rotation $R_t$ and $R_Z$.

Depending on the position of the cradle body 100, the angle of inclination $\alpha$ of the axis of rotation $R_Z$ of the cylinder barrel 7 to the axis of rotation $R_t$ of the drive shaft 4 varies. The cylinder barrel 7 can be pivoted into a null position in which the axis of rotation $R_Z$ of the cylinder barrel 7 is coaxial with the axis of rotation $R_t$ of the drive shaft 4. Starting from this null position, the cylinder barrel 7 can be pivoted to one or both sides so that the axial piston machine 1 in FIG. 1 can be a unilaterally pivotable or a bilaterally pivotable variable displacement machine. A device for pivoting of the cradle body 100 (and thus of the cylinder barrel 7) is not illustrated in detail in FIG. 1 and can be any conventional such device.

The pistons 10 are each fastened to the drive flange 3 in an articulated manner. Between each piston 10 and the drive flange 3, there is a joint 20 in the form of a spherical joint. In the illustrated embodiment, the articulated connection is in the form of a ball joint, which is formed by a ball head 10*a* of the piston 10 and a spherical cap-shaped recess 3*a* formed in the drive flange 3, in which the piston 10 is fastened by the ball head 10*a*.

The pistons 10 each have a collar section 10*b*, with which the piston 10 is positioned in the piston bore 8. A piston rod 10*c* of the piston 10 connects the collar segment 10*b* with the ball head 10*a*.

To make possible an equalization movement of the pistons 10 in the event of a rotation of the cylinder barrel 7, the collar segment 10*b* of the piston 10 is located in the piston bore 8 with some play. The collar segment 10*b* of the piston 10 can be spherical. To create a seal between the pistons 10 and the piston bores 8, sealing means 21, such as a piston ring are located on the collar segment 10*b* of the piston 10.

For mounting and centering of the cylinder barrel 7, a spherical guide 25 is located between the cylinder barrel 7 and the drive shaft 4, respectively. The spherical guide 25 is formed by a spherical segment 26 of the drive shaft 4 on which the cylinder barrel 7 is located, with a hollow spherical segment 27 located in the vicinity of the central longitudinal bore 11. The center of segments 26, 27 lies at the intersection point SP of the axis of rotation $R_t$ of the drive shaft 4 and the axis of rotation $R_Z$ of the cylinder barrel 7.

To achieve the drive of the cylinder barrel 7 during operation of the axial piston machine 1, a drive joint 30 is located between the drive shaft 4 and cylinder barrel 7 that couples the drive shaft 4 and the cylinder barrel 7 in the direction of rotation.

The drive joint 30 has at least one drive body M1-M4 in the form of a slider which is supported in the drive shaft 4 and the cylinder barrel 7. As illustrated in further detail in FIG. 3, each drive body M1-M4 is housed in a respective groove-like bed B1 of the drive shaft 4 and in a groove-like bed B2 in the cylinder barrel 7.

In the illustrated exemplary embodiment, the drive bodies M1-M4 are each in the form of drive body pairs P1-P4 with two half-bodies M1*a*, M1*b* to M4*a*, M4*b*, which are located alternately in the drive shaft 4 and the cylinder barrel 7 and are in contact with each other by contact surfaces BF. Each drive body pair P1-P4 has one cylinder-barrel-side half-body M1*a*, M2*a*, M3*a*, M4*a* respectively that corresponds to the cylinder barrel 7, and one drive-shaft-side half-body M1*b*, M2*b*, M3*b*, M4*b*, respectively, that corresponds to the drive shaft 4. The cylinder-barrel-side half bodies M1*a*, M2*a*, M3*a*, M4*a* of the drive body pair P1-P4 are housed in the groove-like bed B2 of the cylinder barrel 7 and the drive-shaft-side half-bodies M1*b*, M2*b*, M3*b*, M4*b* of the drive body pair P1-P4 are housed in the groove-like bed B1 of the drive shaft 3.

In the illustrated exemplary embodiment, the drive joint 30 is a constant velocity joint that makes possible a rotationally synchronous drive of the cylinder barrel 7 with the drive shaft 4, resulting in a uniform, synchronous rotation of the cylinder barrel 7 with the drive shaft 4.

In the illustrated exemplary embodiment, the drive joint 30 is a cone-beam half-roller joint 31.

The construction of the cone-beam half-roller joint 31 with which the cylinder barrel 7 and the drive shaft 4 are synchronously coupled is described in greater detail below with reference to FIGS. 2 and 3.

The cone-beam half-roller joint 31 is formed by a plurality of roller pairs 50, 51, 52, 53 as the drive body pairs P1, P2, P3, P4, which are located between the drive shaft 4 and a sleeve-shaped driver element 40 which is non-rotationally connected with the cylinder barrel 7.

The sleeve-shaped driver element 40 is located in the central longitudinal bore 11 of the cylinder barrel 7. The driver element 40 is secured to the cylinder barrel 7 in the longitudinal direction, in the axial direction, and in the peripheral direction of the cylinder barrel 7. For securing in the axial direction, and end surface of the driver element 40 is in contact with an end surface on a diametric shoulder 11*a* of the longitudinal bore 11. The driver element 40 is secured to prevent rotation by securing means 45, which in the illustrated exemplary embodiment are formed by a connecting pin located between the sleeve-shaped driver element 40 and the cylinder barrel 7. The drive shaft 4 that extends through the axial piston machine 1 is also extended through the sleeve-shaped driver element 40. The inside diameter of the sleeve-shaped driver element 40 is provided with a contour that is aligned with the longitudinal bore 11 of the cylinder barrel 7.

Each of the plurality of roller pairs 50-53 of the cone-beam half-roller joint 31 includes two (i.e., a pair) of semi-cylindrical half-rollers 50*a*, 50*b*, 51*a*, 51*b*, 52*a*, 52*b*, 53*a*, 53*b* as half-bodies M1*a*, M1*b*, M2*a*, M2*b*, M3*a*, M3*b*, M4*a*, M4*b*. The semi-cylindrical half-rollers 50*a*, 50*b*, 51*a*, 51*b*, 52*a*, 52*b*, 53*a*, 53*b* are each formed by a cylindrical body flattened essentially to an axis of rotation $RR_T$, $RR_Z$. On the flattened sides, the half-rollers arranged in pairs 50*a*, 50*b*, 51*a*, 51*b*, 52*a*, 52*b*, 53*a*, 53*b* each have slide faces GF as the contact surfaces BF, at which the two half-rollers 50*a*, 50*b*, 51*a*, 51*b*, 52*a*, 52*b*, 53*a*, 53*b* of a roller pair 50, 51, 52, 53 are in contact with each other forming a planar contact.

The half-rollers 50*a*, 50*b*, 51*a*, 51*b*, 52*a*, 52*b*, 53*a*, 53*b*, and thus the half-bodies M1*a*, M1*b*, M2*a*, M2*b*, M3*a*, M3*b*, M4*a*, M4*b*, are located in the radial direction inside the reference circle of the pistons 10 and a distance from the axes of rotation $R_t$, $R_Z$. Therefore, the drive joint 30 can be located in a space-saving manner inside the reference circle of the pistons 10 and the drive shaft 4 can be located radially inside the half-rollers of the cone-beam half-roller joint 31.

Each roller pair 50-53 has a cylinder-barrel-side half-roller 50*a*, 51*a*, 52, 53*a* that corresponds to the cylinder barrel 7 and a drive-shaft-side half-roller 50*b*, 51*b*, 52*b*, 53*b* that corresponds to the drive shaft 4, and are in contact with each other on the flat slide faces GF.

The cylinder-barrel-side half-rollers 50*a*, 51*a*, 52, 53*a* of the corresponding roller pairs 50-53 are each held in a cylindrical, or at least partly cylindrical, cylinder-barrel-side receptacle 55*a*, 56*a*, 57*a*, 58*a* in the form of a groove-like bed B2 and the drive-shaft-side half-rollers 50*b*, 51*b*, 52*b*, 53*b* of a roller pair 50-53 are held in a cylindrical, or at least partly cylindrical, drive-shaft-side receptacle 55*b*, 56*b*, 57*b*, 58*b* in the form of groove-like bed B1.

The half-rollers 50*a*, 50*b*, 51*a*, 51*b*, 52*a*, 52*b*, 53*a*, 53*b* are secured in the respective cylindrical receptacles 55*a*, 56*a*, 57*a*, 58*a* 55*b*, 56*b*, 57*b*, 58*b* in the longitudinal direction of the corresponding axis of rotation.

Each half-roller 50*a*, 50*b*, 51*a*, 51*b*, 52*a*, 52*b*, 53*a*, 53*b* is provided in the cylindrical segment with a collar 60, which is engaged in a groove 61 of the corresponding receptacle 55*a*, 56*a*, 57*a*, 58*a*, 55*b*, 56*b*, 57*b*, 58*b*.

In FIG. 2, the drive-shaft-side half-roller 50*b* of the roller pair 50 is represented by darker lines and the cylinder-barrel-side half-roller 50*a* in contact with the half-roller 50*b* is represented in fine lines. The cylinder-barrel-side half-roller 51*a* of the roller pair 51 is represented in darker lines and the drive-shaft-side half-roller 51*b* in contact with the half-roller 51*a* is represented in fine lines. The flattened, plane slide surfaces GF that lie in the sectional plane of the half-rollers 50*b* and 51*a* are shown in FIG. 2.

On the cone-beam half-roller joint 31, as illustrated in FIG. 2, the axes of rotation $RR_t$ of the drive-shaft-side half-rollers 50*b*, 51*b*, 52*b*, 53*b* are inclined with respect to the axis of rotation $R_t$ of the drive shaft 4 by an angle of rotation $\gamma$. The axes of rotation $RR_t$ of the drive-shaft-side half-rollers 50*b*, 51*b*, 52*b*, 53*b* intersect the axis of rotation $R_t$ of the drive shaft 4 at the intersection point $S_t$.

The individual axes of rotation $RR_t$ of the plurality of drive-shaft-side half-rollers 50*b*, 51*b*, 52*b*, 53*b* therefore form a cone beam around the axis of rotation $R_t$ of the drive shaft 4, with the tip of the cone beam at the intersection point $S_t$.

Accordingly, the axes of rotation $RR_z$ of the cylinder-barrel-side half-rollers 50*a*, 51*a*, 52*a*, 53*a* are inclined by an angle of inclination $\gamma$ with respect to the axis of rotation $R_z$ of the cylinder barrel 7. The axes of rotation $RR_z$ of the cylinder-barrel-side half-rollers 50*a*, 51*a*, 52*a*, 53*a* intersect the axis of rotation $R_z$ of the cylinder barrel 7 at the intersection point $S_z$. The individual axes of rotation of the plurality of cylinder-barrel-side half-rollers 50*a*, 51*a*, 52*a*, 53*a* therefore form a cone beam around the axis of rotation $R_z$ of the cylinder barrel 7, with the tip of the cone beam at the point of intersection $S_z$.

The angles of inclination $\gamma$ of the axes of rotation $RR_z$ of the cylinder-barrel-side half-rollers 50*a*, 51*a*, 52*a*, 53*a* with respect to the axis of rotation $R_z$ of the cylinder barrel 7, and the axes of rotation $RR_t$ of the drive-shaft-side half-rollers 50*b*, 51*b*, 52*b*, 53*b* with respect to the axis of rotation $R_t$ of the drive shaft 4, are numerically identical. The angles of inclination $\gamma$ of the axes of rotation $RR_z$, $RR_t$ of the half-rollers of the drive shaft 4 and cylinder barrel 7 to be coupled with each other are therefore identical. Consequently, on each of the corresponding roller pairs 50-53, the axes of rotation $RR_t$ corresponding to the drive shaft 4 and the axes of rotation $RR_z$ corresponding to the cylinder barrel 7 of the two half-rollers that form a roller pair intersect in pairs in a plane E that corresponds to the line bisecting the angle between the axis of rotation $R_t$ of the drive shaft 4 and the axis of rotation $R_z$ of the cylinder barrel 7. The points of intersection SP lying in the plane E at which the axes of rotation $RR_t$ corresponding to the drive shaft 4 intersect in pairs with the axes of rotation $RR_z$ corresponding to the cylinder barrel 7 of the two half-rollers that form a roller pair are illustrated in FIG. 2. The plane E is inclined at one-half the angle of inclination of the pivoting angle $\alpha/2$ with reference to a plane E1 that is perpendicular to the axis of rotation $R_t$ of the drive shaft 4 and a plane E2 that is perpendicular to the axis of rotation $R_z$ of the cylinder barrel 7. The plane E runs through the point of intersection S of the axes of rotation $R_t$, $R_z$.

The half-rollers 50*a*, 50*b*, 51*a*, 51*b*, 52*a*, 52*b*, 53*a*, 53*b* of the respective roller pairs 50, 51, 52, 53 are located in the vicinity of the points of intersection SP of the axes of rotation $RR_t$, $RR_z$, as a result of which, at the points of intersection SP of the two half-rollers of the respective roller pairs 50-53, the transmission of force between the plane slide faces GF takes place to drive the cylinder barrel 7.

As a result of the position of the points of intersection SP of the two half-rollers of the respective roller pairs 50-53 in the plane E that bisects the angle, the perpendicular, radial distances $r_1$, $r_2$ from the points of intersection SP to the axis of rotation $R_t$ of the drive shaft 4 and to the axis of rotation $R_z$ of the cylinder barrel 7 are numerically equal. On account of the equal lever arms formed by the radial distances $r_1$, $r_2$ of the points of intersection SP, the angular velocities of the drive shaft 4 and of the cylinder barrel 7 are equal, as a result of which the cone-beam half-roller joint 31 forms a constant velocity joint that makes possible an exactly rotationally synchronous and uniform drive and rotation of the cylinder barrel 7.

In the operation of the axial piston machine 1 during rotation of the drive shaft 4, with an inclination of the axis of rotation $R_z$ of the cylinder barrel 7 to the axis of rotation $R_t$ of the drive shaft 4 at the angle of inclination or pivoting angle $\alpha$, a sliding of the two slide faces GF of the two half-rollers of each roller pair 50-53 takes place. There is also a rotation of the respective semi-cylindrical half-roller around the respective axis of rotation $RR_t$ or $RR_z$ in the groove-like beds B1, B2 formed by the cylindrical receptacles 55*a*, 56*a*, 57*a*, 58*a*, 55*b*, 56*b*, 57*b*, 58*b* of the respective half-rollers. On account of the inclination of the axes of rotation $RR_t$, $RR_z$ of the respective half-rollers 50*a*, 50*b*, 51*a*, 51*b*, 52*a*, 52*b*, 53*a*, 53*b* and the rotation in the corresponding receptacles 55*a*, 56*a*, 57*a*, 58*a*, 55*b*, 56*b*, 57*b*, 58*b*, the planar slide faces GF of the half-rollers are oriented in contact with each other.

The axial piston machine 1 illustrated in FIGS. 1 to 3 can be operated in both directions of rotation. To achieve a synchronous drive of the cylinder barrel 7 in both directions of rotation, at least one drive body M1-M4 or roller pair 50-53 is provided for each direction of rotation and thus each direction of the drive torque for the drive of the cylinder barrel 7.

In the illustrated exemplary embodiment, the drive bodies M1, M2, and thus the roller pairs 50, 51, are used to drive the cylinder barrel 7 during rotation of the drive shaft 4 in the counterclockwise direction. In this direction of rotation of the drive shaft 4, forces are transmitted at the planar slide faces GF of the half-rollers 50*a*, 50*b* and 51*a*, 51*b* of the roller pairs 50, 51 that generate a drive torque for the drive of the cylinder barrel 7.

In the illustrated exemplary embodiment, the drive bodies M3, M4 and the roller pairs 52, 53 are used to drive the cylinder barrel 7 during rotation of the drive shaft 4 in the clockwise direction. In this direction of rotation of the drive shaft 4, forces are transmitted at the planar slide faces GF of the half-rollers 52*a*, 52*b* and 53*a*, 53*b* of the roller pairs 52, 53 that generate a drive torque for the drive of the cylinder barrel 7.

In the illustrated exemplary embodiment, two respective roller pairs 50, 51 and 52, 53 and two drive bodies M1, M2 and M3, M4, respectively, are provided for each direction of rotation. The drive bodies M1, M2 and the roller pairs 50, 51 for the first direction of rotation and the drive bodies M3, M4 and roller pairs 52, 53 for the second direction of rotation are uniformly distributed over the periphery. Consequently, a radial equalization of forces can be achieved. In the illustrated exemplary embodiment with two roller pairs for each direction of rotation, the roller pairs 50, 51 are offset by a rotational angle of 180° and the roller pairs 52, 53 are offset by a rotational angle of 180°. The roller pairs 50, 51 for the first direction of rotation are offset by a rotational angle of 90° from the roller pairs 52, 53 of the second direction of rotation.

In the illustrated exemplary embodiment, the drive-shaft-side receptacles 55*b*, 56*b*, 57*b*, 58*b* for the drive-shaft-side half-rollers 50*b*, 51*b*, 52*b*, 53*b* and the groove-like beds B1 of the drive bodies M1, M2, M3, M4 are located in the drive shaft 4. In the vicinity of the spherical segment 26, the drive shaft 4 is provided with pocket-shaped recesses 70, 71, 72, 73, on the side surfaces of each of which there is a respective drive-shaft-side receptacle 55*b*, 56*b*, 57*b* 58*b* and, thus, a groove-like bed B1.

In the illustrated exemplary embodiment, the cylinder-barrel-side receptacles 55*a*, 56*a*, 57*a*, 58*a* for the cylinder-drum side half-rollers 50*a*, 51*a*, 52*a*, 53*a* and the groove-like beds B2 of the drive bodies M1, M2, M3, M4 are located in the sleeve-shaped driver element 40. The sleeve-shaped driver element 40 is provided with finger-shaped raised portions 41, 42, 43, 44 that extend toward the drive shaft 4 and in each of which there is a cylinder-barrel-side receptacle 55*a*, 56*a*, 57*a*, 58*a* and a groove-like bed B2. The sleeve-shaped driver element 40 is also provided with a segment 27 in the form of a hollow sphere of the spherical guide 25.

Each finger-shaped raised portion 41, 42, 43 44 of the driver element 40 is engaged in an associated pocket-shaped recess 70, 71, 72, 73 of the drive shaft 4.

The axial piston machine 1 of the invention is designed for operation with a housing 2 emptied of hydraulic fluid. This type of operation means an operation of the axial piston machine 1 in which a low level of hydraulic fluid is present in the housing so that the rotating power unit components are not immersed or are only slightly immersed in hydraulic fluid to prevent churning losses caused by the rotating power unit components during operation of the axial piston machine.

To make possible lubrication and cooling with lubricant on the drive bodies M1-M4 of the drive joint 30, the invention provides a lubrication device 80 for the drive joint 30, by means of which the individual drive bodies M1-M4 are supplied with lubricant, such as hydraulic fluid, from a lubricant port 81 located on the housing 2 of the axial piston machine 1 for cooling and lubrication of the corresponding drive bodies M1-M4.

The lubrication device 80 is located in the drive shaft 4 and has a lubricant channel 82 located in the drive shaft 4.

The lubricant channel 82 is formed by a lubricant supply boring 83 located in the drive shaft 4 and connected with the lubricant port 81. The lubricant channel 82 also has a lubrication boring 84-87 located in the drive shaft for each drive body M1-M4 of the drive joint 30. The lubrication borings 84-87 are each connected to the lubricant supply boring 83 and extend to the peripheral surface of the drive shaft 4. In the peripheral surface of the drive shaft 4, the lubrication borings 84-87 are each provided with an opening 90-93. The opening 90-93 of the lubrication boring 84-87 is located in the illustrated exemplary embodiment in the pocket-shaped recess 70, 71, 72, 73 in the peripheral surface of the drive shaft 4, so that during a rotation of the drive shaft 4, lubricant is fed via the lubricant supply boring 83 and the lubrication borings 84-87 to the associated drive bodies M1-M4 by the centrifugal force that occurs.

The lubrication borings 84-87 in the illustrated exemplary embodiment are each oriented at an angle in the drive shaft 4 and with the openings 90-93 inclined toward the cylinder barrel 7, so that the lubrication borings 84-87 can be introduced into the drive shaft 4 from radially outside, for example, by drilling. The lubrication borings 84-87 can be manufactured in a simple manner in the drive shaft 4, for example, by drilling the lubrication feed boring 83 from radially outside at a desired angle past the groove-like beds B1 of the drive shaft 4.

The angle of inclination of the lubrication borings 84-87 is preferably selected so that the lubrication borings 84-87 are oriented with their longitudinal axis, as illustrated in FIG. 2, toward the axial center area of the drive-shaft-side half-bodies M1*b*, M2*b*, M3*b*, M4*b*. When the drive-shaft-side half-bodies M1*b*, M2*b*, M3*b*, M4*b* are semi-cylindrical half-rollers 50*b*, 51*b*, 52*b*, 53*b*, the lubrication borings 84-87 are oriented with their longitudinal axis, viewed in the axial longitudinal direction of the half-rollers 50*b*, 51*b*, 52*b*, 53*b*, toward their axially central area.

The lubrication borings 84-87 and their openings 90-93 are each directed toward the associated drive bodies M1-M4.

The lubricant discharged by the effect of centrifugal force from the opening 90-93 flows directly to the associated drive bodies M1-M4. The contact surfaces BF of the two half-bodies M1*a*, M1*b* to M4*a*, M4*b* of the respective drive body pair P1-P4 as well as the surface areas with which the half-bodies M1*a*, M1*b* to M4*a*, M4*b* are located in the groove-like beds B1, B2, are therefore wetted directly by the lubricant discharged from the opening 90-93, so that a reliable cooling and lubrication of the drive bodies M1-M4 is achieved with a small quantity of lubricant.

In the illustrated exemplary embodiment, the lubricant supply boring 83 is a longitudinal boring in the drive shaft 4 that is coaxial with the axis of rotation $R_t$ of the drive shaft 4.

In the illustrated exemplary embodiment, the lubricant supply boring 83 in the form of a longitudinal boring extends to the cylinder-barrel-side bearing device 5*b*.

In the vicinity of the cylinder-barrel-side bearing device 5*b*, the lubricant supply boring 83 is provided with a feed opening 95, which is in communication with the lubricant port 81 located on the housing 2 of the axial piston machine 1. The feed opening 95 is located on the axial end surface of the drive shaft 4 and is formed by the boring opening of the lubricant supply boring 83. The lubricant supply boring 83 is a blind hole which can be introduced into the drive shaft 4 from the cylinder-barrel-side end of the drive shaft 4.

To connect the lubricant supply boring 83 with the lubricant supply port 81 on the housing 2, a lubricant chamber 96 is located between the bearing device 5*b*, the end surface of the drive shaft 4, and the housing 2, which is in communication with the lubricant port 81. A cover 97 is located in the boring 14, which is a through boring, and seals the lubricant chamber 96 from the environment. The lubricant port 81 is located on the cover 97, which can be provided with a threaded boring 98, for example, to which the lubricant line can be connected.

By means of the lubricant chamber 96, cooling and lubrication of the cylinder-barrel-side bearing device 5*b* can also be performed by the lubricant fed to the lubricant port 81.

The lubrication device 80 makes it possible, during operation of the axial piston machine 1 with a housing 2 that has been emptied of hydraulic fluid, to supply lubricant, which is fed to the housing-side lubricant port 81 of the axial piston machine 1, for cooling and lubrication of the drive bodies M1-M4 of the drive joint 30 to drive the cylinder barrel 7. The lubrication device 80 also makes it possible to cool and lubricate the cylinder-barrel-side bearing device 5*b* of the drive shaft 4 with the lubricant fed from the housing-side lubricant port 81 of the axial piston machine 1.

As a result of the operation of the axial piston machine 1 with a housing 2 that has been emptied of hydraulic fluid, churning losses can be reduced, so that when the axial piston machine is used in a vehicle with an internal combustion engine drive, fuel savings can be achieved for the internal combustion engine.

The invention is not limited to the illustrated exemplary embodiments. Instead of being a variable displacement machine, the axial piston machine 1 can alternatively be a constant displacement machine. In a constant displacement machine, the angle of inclination $\alpha$ of the axis of rotation $R_Z$ of the cylinder barrel 7 is constant and fixed with respect to the axis of rotation $R_t$ of the drive shaft 4. The control surface 15 with which the cylinder barrel 7 is in contact can be located on the housing 2.

The driver element 40 can be constructed in one piece on the cylinder barrel 7.

It will be readily appreciated by those skilled in the art that modifications may be made to the invention without departing from the concepts disclosed in the foregoing description. Accordingly, the particular embodiments described herein are illustrative only and are not limiting to the scope of the invention, which is to be given the full breadth of the appended claims and any and all equivalents thereof.

The invention claimed is:

1. A hydrostatic axial piston machine with a bent-axis construction, comprising:

a drive shaft rotatable around an axis of rotation inside a housing, wherein the drive shaft includes a drive flange;

a cylinder barrel located inside the housing and rotatable around an axis of rotation, wherein the cylinder barrel includes a plurality of piston bores;

a longitudinally displaceable piston located in each piston bore, wherein the pistons are fastened in an articulated manner to the drive flange;

a drive joint for driving the cylinder barrel located between the drive shaft and the cylinder barrel, wherein the drive joint, includes at least one drive body comprising a slider or a roller body supported on the drive shaft and the cylinder barrel; and a lubrication device to supply lubricant from a lubricant port located on the housing to the drive bodies for cooling and lubrication of the drive bodies, wherein the drive body comprises a drive body pair with two half-bodies, located in alternation in the drive shaft and the cylinder barrel, and are in contact with each other by contact surfaces, wherein the drive body pair has a cylinder-barrel-side half-body that corresponds to the cylinder barrel and a drive-shaft-side half-body that corresponds to the drive shaft, wherein the cylinder-barrel-side half-body of the drive body pair is located in a groove-like bed of the cylinder barrel, and the drive-shaft-side half-body of the drive body pair is located in a groove-like bed of the drive shaft.

2. The hydrostatic axial piston machine as recited in claim 1, wherein the lubrication device is located in the drive shaft and includes a lubricant channel located in the drive shaft.

3. The hydrostatic axial piston machine as recited in claim 2, wherein the lubricant channel includes a lubricant supply boring located in the drive shaft, and connected with the lubricant port, and includes at least one lubrication boring located in the drive shaft and connected to the lubricant supply boring and extends to a peripheral surface of the drive shaft, and is provided in the peripheral surface with an opening, wherein the opening of the lubrication boring is located in the peripheral surface so that during a rotation of the drive shaft, lubricant flows via the lubricant supply boring and the lubrication boring to the drive bodies as a result of centrifugal force.

4. The hydrostatic axial piston machine as recited in claim 3, wherein the lubrication boring is oriented toward the drive bodies.

5. The hydrostatic axial piston machine as recited in claim 3, wherein a plurality of drive bodies are distributed over the periphery, and wherein a lubrication boring is provided for each drive body.

6. The hydrostatic axial piston machine as recited in claim 3, wherein the lubricant supply boring is a longitudinal boring in the drive shaft that is coaxial with the axis of rotation of the drive shaft.

7. The hydrostatic axial piston machine as recited in claim 3, wherein the lubricant supply boring extends to a bearing device, by means of which the drive shaft is rotationally mounted in the housing.

8. The hydrostatic axial piston machine as recited in claim 7, wherein the lubricant supply boring includes in the vicinity of the bearing device with a feed opening, which is in communication with the lubricant port located on the housing of the axial piston machine.

9. The hydrostatic axial piston machine as recited in claim 8, wherein the feed opening is located on an axial end surface of the drive shaft.

10. The hydrostatic axial piston machine as recited in claim 7, wherein a lubricant chamber is located between the bearing device, the end surface of the drive shaft, and the housing, and is in communication with the lubricant port.

11. The hydrostatic axial piston machine as recited in claim 3, wherein the drive shaft is mounted in bearings on both sides of the cylinder barrel, wherein a bearing system for the drive shaft comprises a drive-flange-side bearing device and a cylinder-barrel-side bearing device, and wherein the lubricant supply boring extends to the cylinder-barrel-side bearing device.

12. The hydrostatic axial piston machine as recited in claim 1, wherein the drive body is located in a groove-like bed of the drive shaft and in a groove-like bed of the cylinder barrel.

13. The hydrostatic axial piston machine as recited in claim 1, wherein the lubrication device supplies lubricant to the half-bodies in the vicinity of the contact surfaces and/or in the vicinity of the groove-like beds.

14. The hydrostatic axial piston machine as recited in claim 1, wherein the drive joint is a rotationally synchronous drive joint for synchronous rotation of the cylinder barrel and the drive shaft.

15. The hydrostatic axial piston machine as recited in claim 1, wherein the drive body is located in a radial direction inside the pistons and at a distance from the axes of rotation of the drive shaft and of the cylinder barrel.

16. The hydrostatic axial piston machine as recited in claim 1, wherein the axial piston machine is operable in both directions of rotation, wherein for each direction of rotation at least one drive body is provided for rotationally synchronous drive of the cylinder barrel.

17. The hydrostatic axial piston machine as recited in claim 1, wherein the axial piston machine is a constant displacement machine with a fixed displacement volume.

18. The hydrostatic axial piston machine as recited in claim 1, wherein the axial piston machine is a variable displacement machine with a variable displacement volume, wherein an inclination of the axis of rotation of the cylinder barrel is variable with respect to the axis of rotation of the drive shaft.

* * * * *